US010067463B2

(12) United States Patent
Uchida et al.

(10) Patent No.: US 10,067,463 B2
(45) Date of Patent: Sep. 4, 2018

(54) IMAGE FORMING APPARATUS

(71) Applicant: KYOCERA Document Solutions Inc., Osaka (JP)

(72) Inventors: Kosuke Uchida, Osaka (JP); Hiroshi Inui, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/518,400

(22) PCT Filed: Oct. 27, 2015

(86) PCT No.: PCT/JP2015/080198
§ 371 (c)(1),
(2) Date: Apr. 11, 2017

(87) PCT Pub. No.: WO2016/068115
PCT Pub. Date: May 6, 2016

(65) Prior Publication Data

US 2017/0300006 A1 Oct. 19, 2017

(30) Foreign Application Priority Data

Oct. 31, 2014 (JP) ..... 2014-222252

(51) Int. Cl.
*G03G 21/16* (2006.01)
*G03G 15/20* (2006.01)

(52) U.S. Cl.
CPC ..... *G03G 21/1666* (2013.01); *G03G 15/2025* (2013.01); *G03G 15/2053* (2013.01);
(Continued)

(58) Field of Classification Search
CPC ..... G03G 21/1647; G03G 21/1666
See application file for complete search history.

(56) References Cited

U.S. PATENT DOCUMENTS 6,271,869 B1 * 8/2001 Tada ..... G02B 26/0816 347/116
2006/0158728 A1 * 7/2006 Masaki ..... G03G 15/04 359/460
2007/0279719 A1 * 12/2007 Miyamoto ..... G02B 26/125 359/221.2

FOREIGN PATENT DOCUMENTS

JP H06-249224 A 9/1994
JP H06-289307 A 10/1994

OTHER PUBLICATIONS

An Office Action; "Notification of Reasons for Refusal" issued by the Japanese Patent Office dated Mar. 6, 2018, which corresponds to Japanese Patent Application No. 2016-556574 and is related to U.S. Appl. No. 15/518,400; with English translation.

* cited by examiner

*Primary Examiner* — Kristal Feggins
*Assistant Examiner* — Kendrick Liu
(74) *Attorney, Agent, or Firm* — Studebaker & Brackett PC

(57) ABSTRACT

An image forming apparatus (1) includes a frame (61) supporting an attached object (23) inserted into an apparatus body (2) and an attachment device (62) fixing the attached object (23) supported by the frame (61). The frame (61) includes a leading end plate (61*b*) facing to a leading end in an inserting direction of the attached object (23). The attached object (23) includes a fixing pin (65) supported by the leading end plate (61*b*) in advanceable/retreatable state along the inserting direction and formed connectable to the attached object (23), a biasing member (66) biasing the fixing pin (65) toward the inserting direction and a locking member (67) restricting dropout of the fixing pin (65). The attachment device (62) holds the attached object (23) being connected to the fixing pin (65) and receiving the biasing
(Continued)

force of the biasing member (67) at a position gravitated to the leading end plate (61*b*).

3 Claims, 7 Drawing Sheets

(52) U.S. Cl.
CPC ..... *G03G 21/1619* (2013.01); *G03G 21/1647* (2013.01); *G03G 21/1685* (2013.01); *G03G 2215/2025* (2013.01); *G03G 2215/2035* (2013.01)

IMAGE FORMING APPARATUS

TECHNICAL FIELD

The present invention relates to an image forming apparatus suitably used for a copying machine, a printer or the like.

BACKGROUND ART

An electrographic image forming apparatus includes an optical scanning device emitting scanning light. The optical scanning device irradiates a surface of a photoreceptor by the scanning light to form an electrostatic latent image corresponding with image data.

For example, an image forming apparatus includes a base of the optical scanning device, two positioning pins press-fitted into the base and inserted into holes of a device body, and pressing members pressing the respective positioning pins from a radial direction (refer to Patent Document 1). If each pressing member is fastened by a screw, each positioning pin is fixed in a pressed state. That is, the base is positioned to the device body via each positioning pin. Subsequently, the optical scanning device is fastened to the positioned base with a plurality of screws.

PRIOR ART DOCUMENT

Patent Document

[PATENT DOCUMENT 1] Japanese patent laid-open publication No. H06-289307

SUMMARY OF INVENTION

Problems to be Solved by the Invention

However, because the above-mentioned technique fastens the optical scanning device as an attached object by a normal screw, it is difficult to carry out attaching/detaching work of the optical scanning device in an apparatus body of the image forming apparatus. Concretely, because the inside of the apparatus body is a greatly narrow space, a work positioning and screwing the screw into a screw hole is not easy. That is, the above-mentioned technique has a problem that maintenance or the like of the optical scanning device is hardly executed. Moreover, there are many cases losing the removed screw.

the present invention provides, in order to the above-mentioned problem, an image forming apparatus facilitating attaching/detaching of an attached object and preventing loss of a fastening member of the attached object.

Means for Solving the Problem

An image forming apparatus of the present invention includes an attached object composing an image forming part, a frame supporting the attached object inserted from one side to another side into an apparatus body and an attachment device fixing the attached object supported by the frame. The frame includes a leading end plate arranged to face to a leading end in an inserting direction of the attached object. The attachment device is configured to include a fixing pin supported by the leading end plate in a state capable of advancing/retreating along the inserting direction of the attached object and formed connectable to the leading end in the inserting direction of the attached object, a biasing member biasing the fixing pin toward the inserting direction of the attached object and a locking member restricting dropout of the fixing pin biased by the biasing member. The attachment device holds the attached object being connected to the fixing pin and receiving an action of the biasing force of the biasing member at a position gravitated to the leading end plate.

Effects of the Invention

In accordance with the invention, it is possible to facilitate attaching/detaching of an attached object and to prevent loss of a fastening member of the attached object.

DESCRIPTION OF EMBODIMENTS

Hereinafter, with reference to accompanying figures, suitable embodiment of the present invention will be described. Incidentally, hereinafter, the description is based on directions indicated in each figure.

Figure 1:
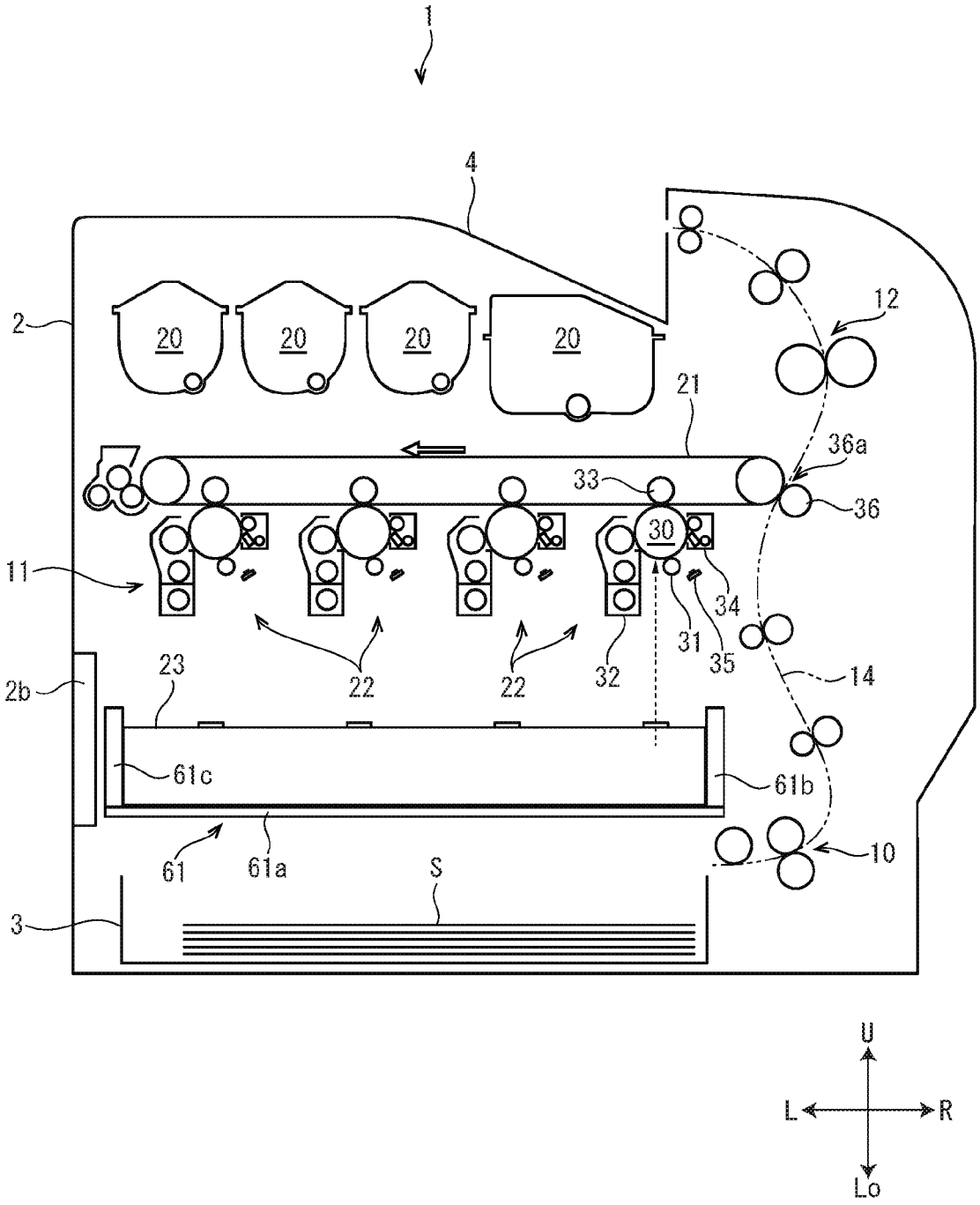
FIG. 1 It is a side face view schematically showing an internal structure of a color printer according to an embodiment of the present invention.

With reference to FIG. 1, the entire structure of a color printer 1 as an image forming apparatus will be described. FIG. 1 is a side face view schematically showing an internal structure of the color printer 1.

The color printer 1 includes a box-formed apparatus body 2, a sheet feeding cartridge 3 arranged in a lower part of the apparatus body 2 and an ejected sheet tray 4 arranged in an upper part.

Moreover, the color printer 1 includes a sheet feeding part 10, an image forming part 11 and a fixing device 12. The sheet feeding part 10 is arranged at an upstream side of a conveying path 14 to feed a sheet S in the feeding cartridge 3 to the conveying path 14. The image forming part 11 is arranged at a roughly center inside the apparatus body 2. The fixing device 12 is arranged at a downstream side of a conveying path 14. Incidentally, the sheet S stored in the feeding cartridge 3 is not limited to a paper sheet, but may be a resin film, OHP sheet or the like.

The image forming part 11 includes four toner containers 20, an intermediate transferring belt 21, four drum units 22 and an optical scanning device 23. The four toner containers 20 are arranged in parallel in left and right directions below the ejected sheet tray 4. The intermediate transferring belt 21 is arranged below each toner container 20. The four drum units 22 are arranged in parallel in the left and right directions at the lower side of the intermediate transferring belt 21. The optical scanning device 23 is arranged below each drum unit 22.

The four toner containers 20 contain respective toners (two-component developers) of four colors (yellow (Y), magenta (M), cyan (C) and black (K)). The intermediate transferring belt 21 is disposed around a pair of left and right rollers so as to run in an arrow direction in FIG. 1. The toner contained in the toner container 20 may be one-component developer composed of a magnetic toner.

The four drum units 22 are provided so as to correspond with the toners of the respective color. Each drum unit 22 includes a photosensitive drum 30, a charging device 31, a developing device 32, a primary transferring roller 33, a cleaning device 34 and a static eliminating device 35. Incidentally, because the four drum units 22 have similar configurations to each other, one drum unit 22 is described hereinafter.

The photosensitive drum 30 is formed in a cylindrical shape elongated in forward and backward directions and is supported by the apparatus body 2 so as to rotate around an axial center. The photosensitive drum 30 contacts with a lower side surface of the intermediate transferring belt 21. The charging device 31, the developing device 32, the primary transferring roller 33, the cleaning device 34 and the static eliminating device 35 are located around the photosensitive drum 30 in order of transferring processes. The primary transferring roller 33 is located to face to the photosensitive drum 30 from the upper side across the intermediate transferring belt 21. At the right side of the intermediate transferring belt 21, a secondary transferring roller 36 is arranged to form a secondary transferring nip part 36*a*.

Here, an operation of the color printer 1 will be described. A controlling device (not shown) of the color printer 1 executes image forming process on the basis of inputted image data as follows.

Each charging device 31 electrically charges a surface of each photosensitive drum 30. The optical scanning device 23 carries out exposure (refer to an arrow of a broken line in FIG. 1) corresponding with image data toward the photosensitive drum 30. Each developing device 32 develops an electrostatic latent image formed on the surface of each photosensitive drum 30 to a toner image. Four toner images carried on the respective photosensitive drums 30 are primarily transferred to the running intermediate transferring belt 21 in order by the primary transferring rollers 33 onto which primary transferring biases are applied. Thereby, on the surface of the intermediate transferring belt 21, a full color toner image is formed.

on the other hand, the sheet S fed from the feeding cartridge 3 is conveyed on the conveying path 14 and passed through the secondary transferring nip part 36*a*. The full color toner image is secondarily transferred to the sheet S by the secondary transferring roller 36 onto which secondary transferring bias is applied. The fixing device 12 fixes the full color toner image to the sheet S. The sheet S after fixing process is ejected to the ejected sheet tray 4. The cleaning device 34 removes the toner remained on the surface of the photosensitive drum 30 after transferring. The static eliminating device 35 irradiates a static eliminating light to remove electric charge on the photosensitive drum 30.

Figure 2:
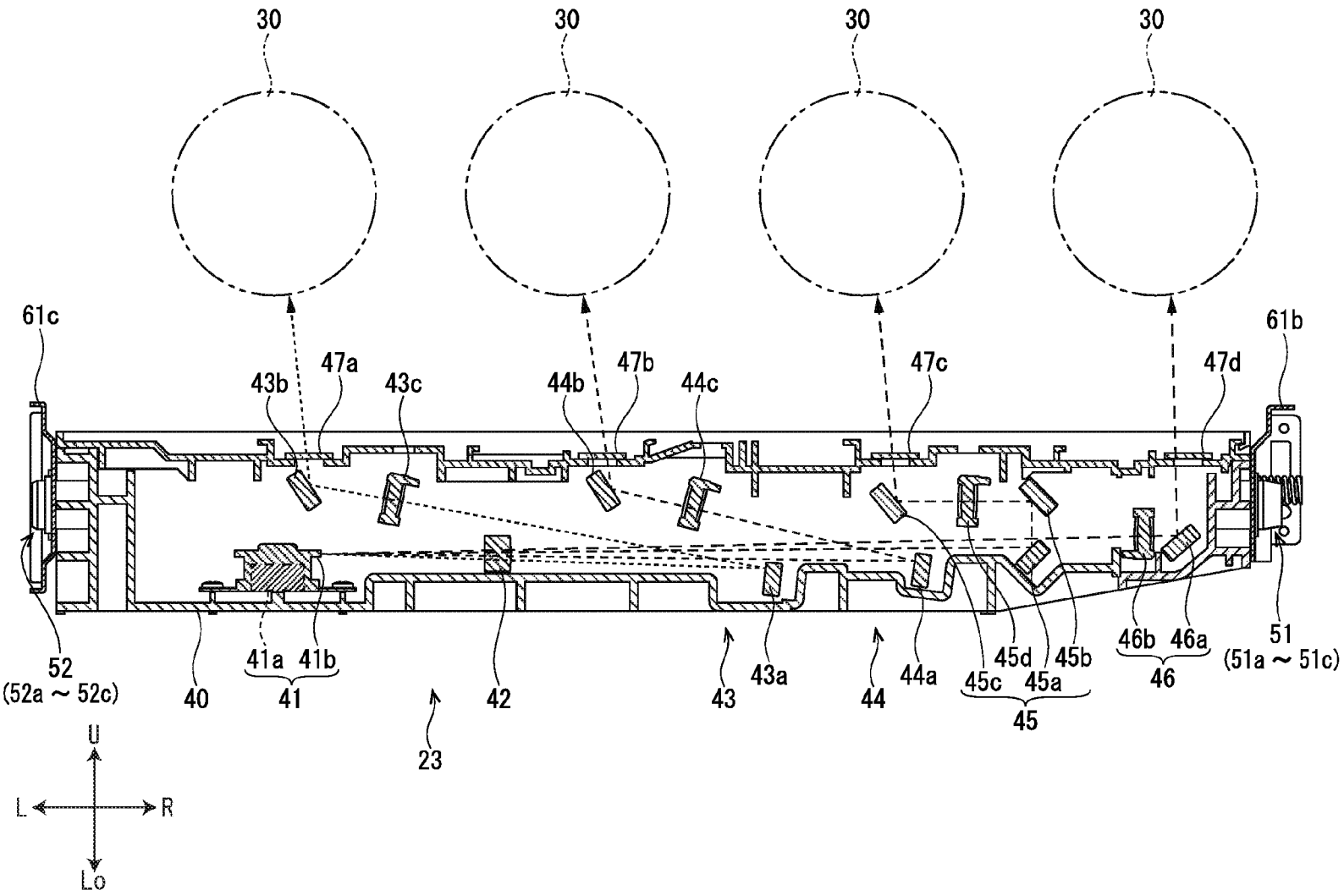
FIG. 2 It is a sectional view schematically showing the internal structure of an optical scanning device in the color printer according to the embodiment of the present invention.

Next, with reference to FIG. 2, the optical scanning device 23 composing the image forming part 11 will be described. FIG. 2 is a sectional view schematically showing the internal structure of the optical scanning device 23.

The optical scanning device 23 includes an optical box 40, a deflector 41, a first Fθ lens 42 and first, second, third and fourth optical element groups 43, 44, 45 and 46. The deflector 41, the first Fθ lens 42 and the optical element groups 43 to 46 are contained in the optical box 40. The four optical element groups 43, 44, and 46 are provided so as to correspond with the photosensitive drums 30 for the respective colors.

The optical box 40 is formed in a roughly rectangular parallelepiped shape flattened in upward and downward directions. The optical box 40 is made of resin material having low linear expansion coefficient in order to restrain thermal deformation. On an upper face of the optical box 40, four glass plates 47*a*, 47*b*, 47*c* and 47*d* are arranged in parallel in the left and right directions at positions corresponding with the respective photosensitive drum 30.

The deflector 41 is arranged at the left side on a bottom face of the optical box 40. The deflector 41 is configured to include a polygon motor 41*a* and a polygon mirror 41*b*. The polygon motor 41*a* is located on the bottom face of the optical box 40 in a state that its axial shaft is extended vertically upward. The polygon mirror 41*b* is fixed to the axial shaft of the polygon motor 41*a*. The polygon mirror 41*b* is configured to rotate by driving the polygon motor 41*a* and to deflect laser light emitted from a light source (not shown). Thereby, the laser light is distributed to the four optical element groups 43 to 46.

The first Fθ lens 42 is formed in a roughly bar shape elongated in the forward and backward directions (a main scanning direction). The first Fθ lens 42 is located at the right side of the deflector 41 on the bottom face of the optical box 40. The first Fθ lens 42 is provided to narrow a diameter in the main scanning direction of the laser light deflected by the deflector 41 and to make constant scanning speed of the laser light on the surface of the photosensitive drum 30.

The first optical element group 43 includes a first mirror 43*a*, a second mirror 43*b* and a second Fθ lens 43*c*. The first mirror 43*a* and the second mirror 43*b* are roughly rectangular flat mirrors elongated in the forward and backward directions. The first mirror 43*a* is located at a center part in the left and right directions on the bottom face of the optical box 40. The second mirror 43*b* is located near the lower side of the left end glass plate 47*a*. The second Fθ lens 43*c* is formed in a roughly bar shape elongated in the forward and backward directions and is provided to narrow a diameter in a sub scanning direction of the laser light deflected by the deflector 41. The second Fθ lens 43*c* is located between the first mirror 43*a* and the second mirror 43*b*.

The second optical element group 44 includes a first mirror 44*a*, a second mirror 44*b* and a second Fθ lens 44*c*. Incidentally, hereinafter, description about roughly similar structure to the first optical element group 43 is omitted. The first mirror 44*a* is located at the right side of the first mirror 43*a* on the bottom face of the optical box 40. The second mirror 44*b* is located near the lower side of the glass plate 47*b* at the second from the left end. The second Fθ lens 44*c* is located between the first mirror 44*a* and the second mirror 44*b*.

The third optical element group 45 includes a first mirror 45*a*, a second mirror 45*b*, a third mirror 45*c* and a second Fθ lens 45*d*. The first mirror 45*a* is located at the right side of the first mirror 44*a* on the bottom face of the optical box 40. The second mirror 45*b* is located above the first mirror 45*a* to face to it. The third mirror 45*c* is located near the lower side of the glass plate 47*c* at the third from the left end. The second Fθ lens 45*d* is located between the second mirror 45*b* and the third mirror 45*c*.

The fourth optical element group 46 includes a first mirror 46*a* and a second Fθ lens 46*b*. The first mirror 46*a* is located below the right end glass plate 47*d* on the bottom face of the optical box 40. The second Fθ lens 46*b* is located at the left side of the first mirror 46*a* to face to it.

The laser light passed through the first Fθ lens 42 is progressed as indicated by an arrow of a broken line in FIG. 2 to pass through the respective second Fθ lenses 43*c*, 44*c*, 45*d* and 46*b*, and then, reflected by the respective mirrors 43*b*, 44*b*, 45*c* and 46*a* facing to the respective glass plates 47*a*, 47*b*, 47*c* and 47*d* and imaged on the respective photosensitive drums 30.

Figure 3:
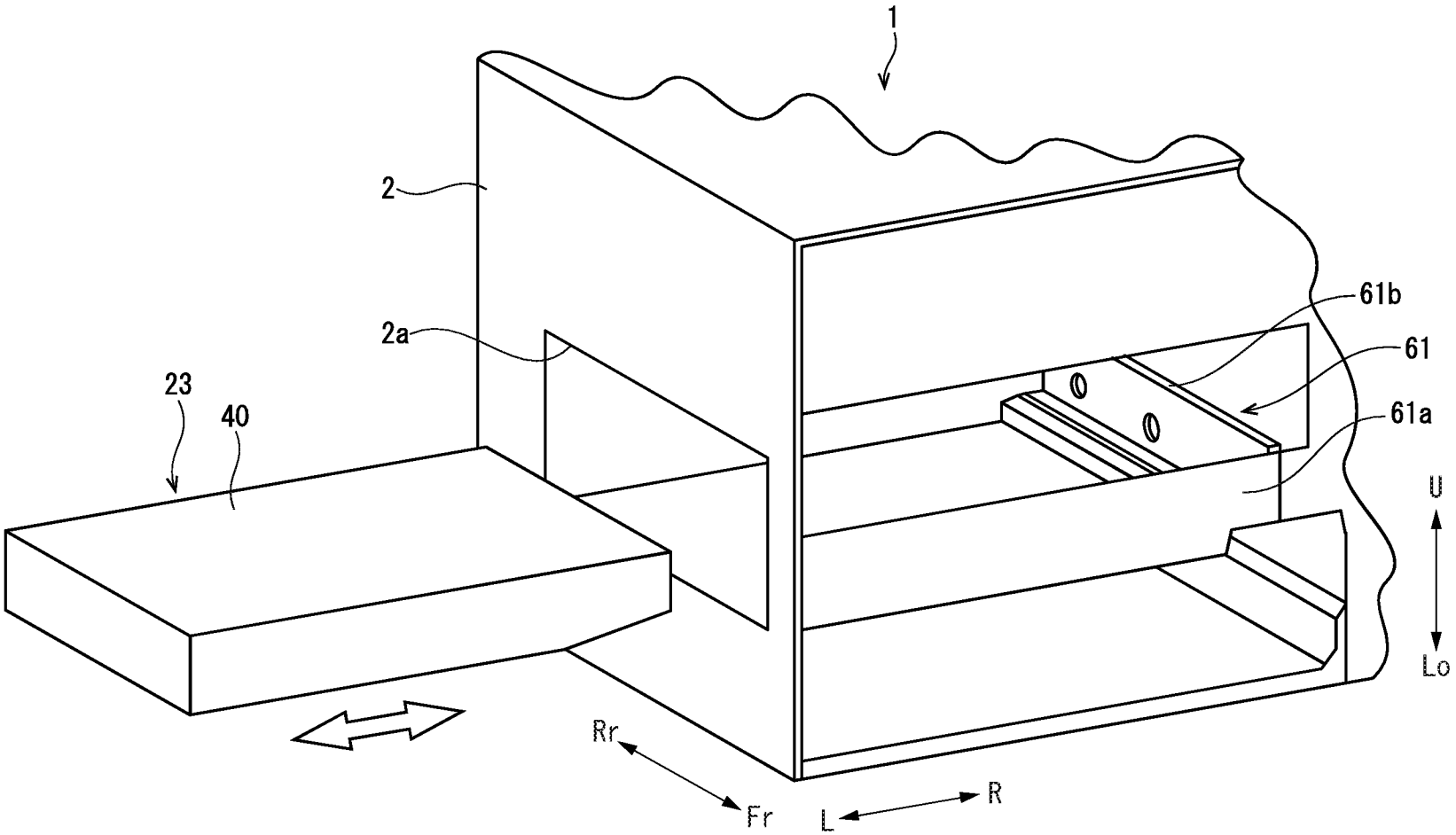
FIG. 3 It is a perspective view schematically showing a situation attaching/detaching the optical scanning device to/from an apparatus body in the color printer according to the embodiment of the present invention.

Incidentally, as shown in FIG. 3, the optical scanning device 23 is installed in an attachable/detachable state inside the apparatus body 2. At a left face of the apparatus body 2, an apparatus opening 2*a* used for inserting the optical scanning device 23 is formed. The apparatus opening 2*a* is formed in a roughly rectangular shape and covered by an openable/closable cover 2*b* (refer to FIG. 1).

Figure 4:
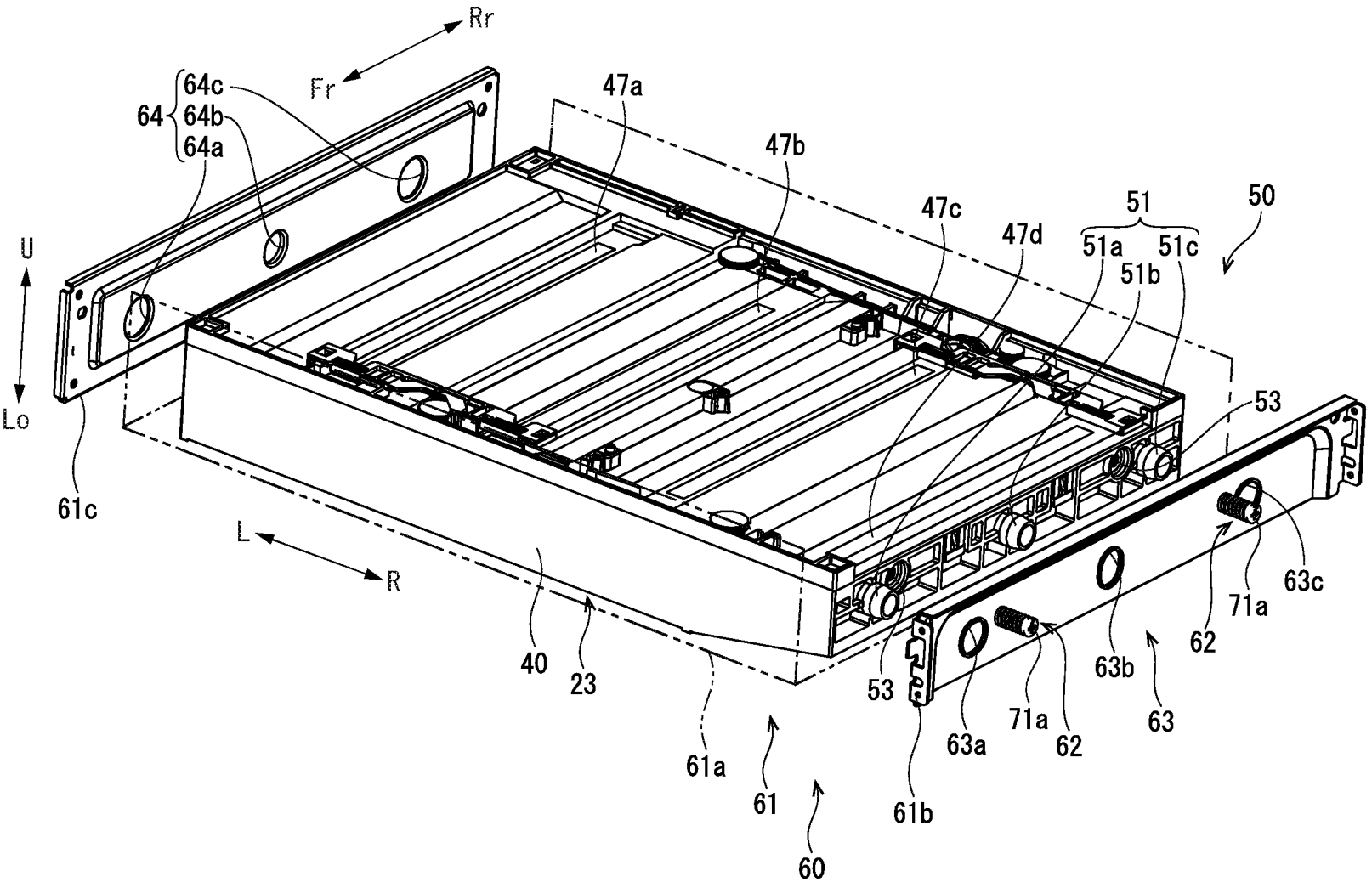
FIG. 4 It is a perspective view showing an attaching mechanism of the optical scanning device and others as viewed from the right side in the color printer according to the embodiment of the present invention.
Figure 5:
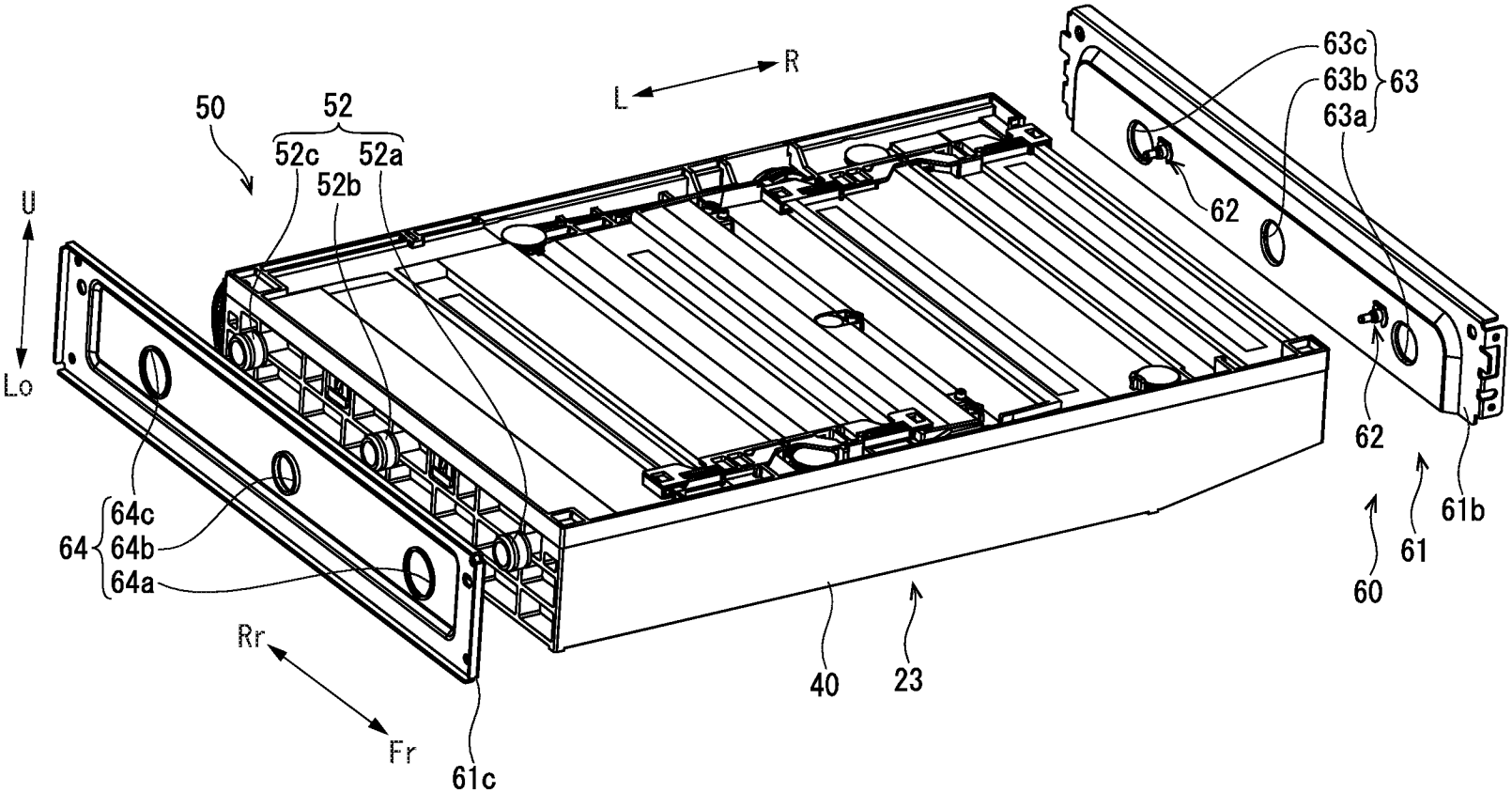
FIG. 5 It is a perspective view showing the attaching mechanism of the optical scanning device and others as viewed from the right side in the color printer according to the embodiment of the present invention.
Figure 6:
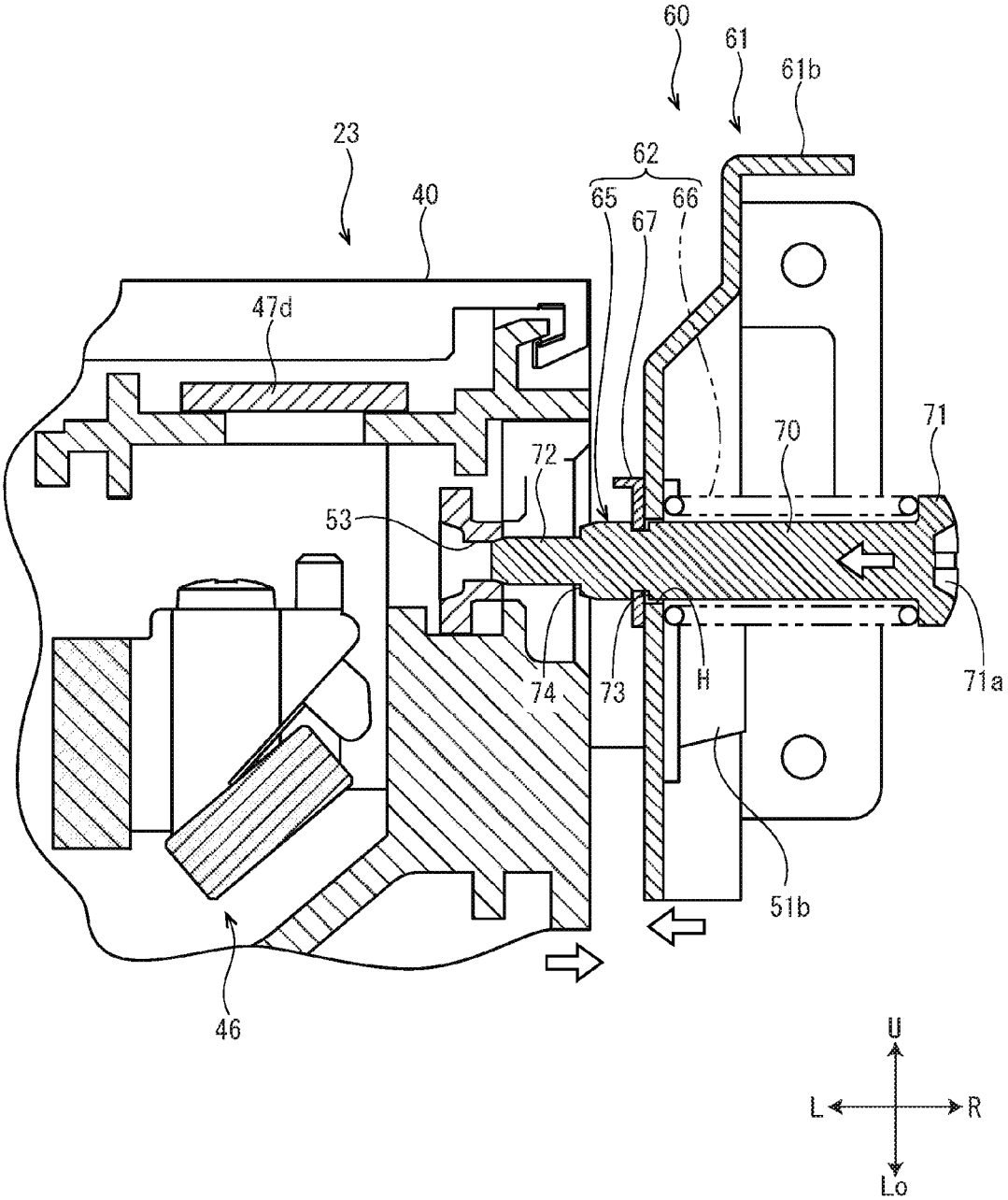
FIG. 6 It is a sectional view schematically showing the attaching mechanism of the optical scanning device and others in a state before connection in the color printer according to the embodiment of the present invention.

Next, with reference to FIGS. 4, 5 and 6, an attaching mechanism 60 used for installing the optical scanning device 23 as an attached object into the apparatus body 2 will be described. FIG. 4 is a perspective view showing the attaching mechanism 60 of the optical scanning device 23 and others as viewed from the right side. FIG. 5 is a perspective view showing the attaching mechanism 60 of the optical scanning device 23 and others as viewed from the right side. FIG. 6 is a sectional view schematically showing the attaching mechanism 60 and others before connection.

Firstly, with reference to FIGS. 4 and 5, prior to description of the attaching mechanism 60 of the optical scanning device 23, an attached mechanism 50 provided in the optical scanning device 23 will be described.

The attached mechanism 50 of the optical scanning device 23 includes a first positioned part 51, a second positioned part 52 and a pair of front and rear screw holes 53. The first positioned part 51 is arranged on a right end face (a leading end in an inserting direction) of the optical box 40 and the second positioned part 52 is arranged on a left end face (a trailing end in the inserting direction) of the optical box 40. The pair of front and rear screw holes 53 are arranged on the right end face of the optical box 40.

The first positioned part 51 is composed of three first positioning bosses 51*a*, 51*b* and 51*c* arranged in parallel in the forward and backward direction (a horizontal direction) on the right end face (a leading end face) of the optical box 40 (refer to FIG. 4). The respective first positioning bosses 51*a* to 51*c* are formed in columnar shapes and protruded from the right end face of the optical box 40 toward the right side. On the other hand, the second positioned part 52 is composed of three second positioning bosses 52*a*, 52*b* and 52*c* arranged in parallel in the forward and backward direction (the horizontal direction) on the left end face (a trailing end face) of the optical box 40 (refer to FIG. 5). The respective second positioning bosses 52*a* to 52*c* are formed in columnar shapes and protruded from the left end face of the optical box 40 toward the left side. Incidentally, all of the positioning bosses 51*a* to 51*c* and 52*a* to 52*c* are formed in the same shape and size as each other and their top ends are formed in tapered shapes.

Moreover, the second positioning boss 52*b* at the center in the forward and backward directions is arranged coaxial to the first positioning boss 51*b* at the center in the forward and backward directions. The second positioning bosses 52*a* and 52*c* at both ends in the forward and backward directions are arranged coaxial to the first positioning boss 51*a* and 51*c* at both ends in the forward and backward directions.

As shown in FIG. 4, the pair of front and rear screw holes 53 are formed on the right end face of the optical box 40 so as to be hollowed. The pair of front and rear screw holes 53 are arranged between a pair of front and rear first positioning bosses 51*a* and 51*c* and near the pair of front and rear first positioning bosses 51*a* and 51*c*.

Next, the attaching mechanism 60 of the optical scanning device 23 will be described. As shown in FIG. 4, the attaching mechanism 60 of the optical scanning device 23 is configured to include a frame 61 and a pair of front and rear attachment devices 62. The frame 61 is configured to support the optical scanning device 23 inserted from the left face of the apparatus body 2 toward the right side (refer to FIG. 3). Each attachment device is provided to fix the optical scanning device 23 supported by the frame 61.

The frame 61 is made of metal plate material and formed in a roughly rectangular box shape having an opened upper face. The frame 61 is arranged to extend horizontally from the apparatus opening 2*a* toward the inside (the right side) (refer to FIG. 3). The frame 61 is arranged to partition an arrangement space of the sheet feeding cartridge 3 and an arrangement space of the image forming part 11.

As shown in FIG. 4, the frame 61 is configured to include a body plate 61*a*, a leading end plate 61*b* and a trailing end plate 61*c*.

The body plate 61*a* is formed in a roughly U-shape as viewed from a lateral side. The body plate 61*a* is configured to come into contact with a lower face and both front and rear side faces of the optical box 40 and to support the optical scanning device 23.

As shown in FIGS. 4 and 5, the leading end plate 61*b* is formed in a roughly rectangular plate shape elongated in the forward and backward directions viewed from the lateral side. The leading end plate 61*b* is erected at a right end of the body plate 61*a* so as to face to a right end (a leading end in the inserting direction) of the optical scanning device 23. Incidentally, the leading end plate 61*b* is arranged at the left side of an arrangement space of the conveying path 14 so as not to interfere with the conveying path 14 (refer to FIG. 1).

The leading end plate 61*b* includes a first positioning part 63 engaging with the first positioned part 51 of the optical scanning device 23. Concretely, the first positioning part 63 is composed of three first positioning holes 63*a*, 63*b* and 63*c* arranged in parallel in the forward and backward directions (the horizontal direction) on the leading end plate 61*b*. The respective first positioning holes 63*a* to 63*c* penetrate the leading end plate 61*b* in the left and right directions. The first positioning hole 63*b* at the center in the forward and backward directions is formed in an ellipse shape elongated in the upward and downward directions (a vertical direction) and the first positioning holes 63*a* and 63*c* at both ends in the forward and backward directions are formed in an ellipse shape elongated in the forward and backward directions.

The trailing end plate 61*c* is erected at a left end of the body plate 61*a* so as to face to a left end (a trailing end in the inserting direction) of the optical scanning device 23.

The trailing end plate 61*c* is fastened to left ends of both front and rear side walls of the body plate 61*a* by a plurality of screws (not shown).

The trailing end plate 61*c* includes a second positioning part 64 engaging with the second positioned part 52 of the optical scanning device 23. Concretely, the second positioning part 64 is three second positioning holes 64*a*, 64*b* and 64*c* arranged in parallel in the forward and backward directions (the horizontal direction) on the trailing end plate 61*c*. The respective second positioning holes 64*a* to 64*c* penetrate the trailing end plate 61*c* in the left and right directions and are formed in perfect circle shapes as viewed from the lateral side. The second positioning holes 64*a* and 64*c* at both ends in the forward and backward directions are formed to have a diameter larger than the second positioning hole 64*b* at the center in the forward and backward directions.

Moreover, the second positioning hole 64*b* at the center in the forward and backward directions is located coaxial to the first positioning hole 63*b* at the center in the forward and backward directions. The second positioning holes 64*a* and 64*c* at both ends in the forward and backward directions are respectively located coaxial to the first positioning holes 63*a* and 63*c* at both ends in the forward and backward directions.

As shown in FIG. 4, the front and rear attachment devices 62 are arranged on the leading end plate 61*b*. The front and rear attachment devices 62 are arranged between a pair of front and rear first positioning holes 63*a* and 63*c* and near the pair of front and rear first positioning holes 63*a* and 63*c*. Incidentally, because a pair of attachment devices 62 have the same structure as each other, hereinafter, one attachment device 62 will be described.

As shown in FIG. 6, the attachment device 62 is configured to include a fixing pin 65, a biasing member 66 and a locking member 67.

The fixing pin 65 includes a pin body 70, a head portion 71 and a screw portion 72. The fixing pin 65 is integrally made of metal material, such as stainless steel, for example.

The pin body 70 is formed in a columnar shape elongated in the left and right directions. The pin body is slidably supported by a pin supporting hole H penetrating the leading end plate 61*b*. At the left side on a peripheral face of the pin body 70, a fitting groove 73 is hollowed.

The head portion 71 is formed in a cylindrical shape flattened in the left and right directions. The head portion 71 is fixed to a right end of the pin body 70 to be coaxial to the pin body 70. The head portion 71 is formed to have a diameter (larger than the pin body 70) not passing through the pin supporting hole H and located at the right side of the leading end plate 61*b*. On an outside end face (a right end face) of the head portion 71, a cross groove 71*a* into which a top end of a Phillips head screwdriver (not shown) is fitted is hollowed (refer to FIG. 4).

The screw portion 72 is an external thread formed in a left end of the pin body 70. The screw portion 72 is formed to have a diameter smaller than the pin body 70. Therefore, between the pin body 70 and the screw portion 72, a step portion 74 is formed. The screw portion 72 is located at the left side of the leading end plate 61*b*.

The biasing member 66 is a so-called coil spring and is arranged between the leading end plate 61*b* and the head portion of the fixing pin 65 so as to be wound around the pin body 70. The biasing member 66 biases the fixing pin 65 toward the inserting direction (the right direction) of the optical scanning device 23 by using a right side face of the leading end plate 61*b* as a pedestal.

The locking member 67 is formed in an annular plate shape and fitted into the fitting groove 73 of the pin body 70. The locking member 67 is formed to have a diameter not passing through the pin supporting hole H and located at the left side of the leading end plate 61*b*. That is, the locking member 67 restricts dropout of the fixing pin 65 biased by the biasing member 66.

Figure 7:
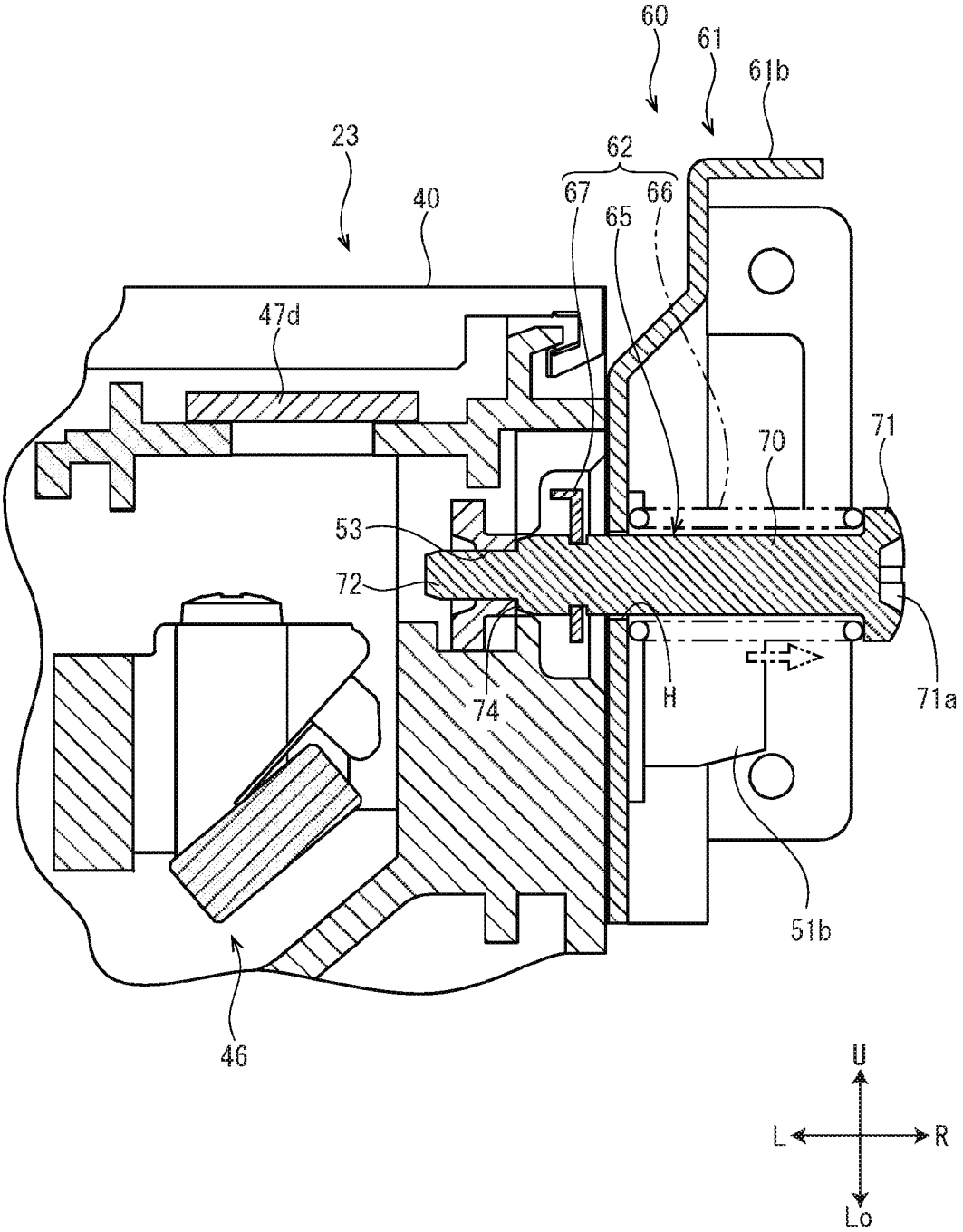
FIG. 7 It is a sectional view schematically showing the attaching mechanism of the optical scanning device and others in a state after connection in the color printer according to the embodiment of the present invention.

Next, with reference to FIGS. 6 and 7, attachment procedure (operation of each attachment device 62) of the optical scanning device 23 to the frame 61 will be described. FIG. 7 is a sectional view schematically showing the attaching mechanism 60 and others after connection. Incidentally, because the pair of attachment devices 62 have the same operation as each other, hereinafter, the operation of one attachment device 62 will be described.

Firstly, a worker opens the cover 2*b* of the apparatus body 2 to make the frame 61 exposed and detaches the trailing end plate 61*c* (refer to FIG. 3).

Next, the worker makes the optical scanning device 23 inserted so as to be slid on the body plate 61*a*. The respective first positioning bosses 51*a* to 51*c* of the optical scanning device 23 (the optical box 40) are inserted into the respective first positioning holes 63*a* to 63*c* of the leading end plate 61*b* (refer to FIGS. 2, 4 and 6). At this time, the first positioning boss 51*b* at the center in the forward and backward directions is fitted into the first positioning hole 63*b* elongated vertically at the center in the forward and backward directions so as not to move in the forward and backward directions. The pair of front and rear first positioning bosses 51*a* and 51*c* are respectively fitted into the first positioning holes 63*a* and 63*c* elongated horizontally so as not to move in the upward and downward directions. Thereby, the leading end (the right side) in the inserting direction of the optical scanning device 23 is positioned in the upward and downward directions and in the forward and backward directions.

Subsequently, the worker fits the top end of the Phillips head screwdriver into the cross groove 71*a* of the head portion 71 of the fixing pin 65 from the right side of the apparatus body 2. The worker turns the Phillips head screwdriver to screw the screw portion 72 of the fixing pin 65 into the screw hole 53 of the optical box 40. As screwing of the screw portion 72 into the screw hole 53 is advanced, the fixing pin 65 is relatively moved in the left direction against biasing force of the biasing member (refer to FIG. 6). On the other hand, the optical scanning device 23 is gravitated to the leading end plate 61*b* (refer to FIG. 6). The fixing pin 65 is fastened until the step portion 74 comes into contact with the opening edge of the screw hole 53, thereby being connected to the optical scanning device 23 (refer to FIG. 7).

In a state that the fixing pin 65 is connected to the optical scanning device 23, the biasing member 66 is compressed between the leading end plate 61*b* and the head portion 71. Thereby, the biasing member 66 biases the optical scanning device 23 in the right direction via the fixing pin 65 (refer to an arrow of two-dot chain line in FIG. 7). Therefore, the optical scanning device 23 is gravitated to the leading end plate 61*b* and the right end face of the optical box 40 is maintained in a state of closely contacting with a left side face the leading end plate 61*b*. As described above, the attachment device 62 holds the optical scanning device 23 being connected to the fixing pin 65 and receiving an action of the biasing force of the biasing member 66 at a position gravitated to the leading end plate 61*b*'s side (the right side). That is, the optical scanning device 23 becomes a state positioned in the left and right directions (the inserting direction).

Next, the worker locates the trailing end plate 61*c* so as to cover the left end of the optical scanning device 23 (refer to FIGS. 2 and 5). The respective second positioning bosses 52*a* to 52*c* of the optical scanning device 23 (the optical box 40) are fitted into the respective second positioning holes 64*a* to 64*c* of the trailing end plate 61*c*. At this time, the second positioning boss 52*b* at the center in the forward and backward directions is unmovably fitted into the second positioning hole 64*b* at the center in the forward and backward directions. Thereby, the trailing end (the left side) in the inserting direction of the optical scanning device 23 is positioned in the upward and downward directions and in the forward and backward directions. Incidentally, the pair of front and rear second positioning bosses 52*a* and 52*c* are freely fitted into the pair of front and rear second positioning holes 64*a* and 64*c*. That is, the second positioning hole 64*b* at the center in the forward and backward directions has a positioning function.

The worker fastens the trailing end plate 61*c* to the body plate 61*a* by a plurality of screws. Finally, if the cover 2*b* is closed, attaching work of the optical scanning device 23 to the frame 61 is finished. Consequently, the optical scanning device 23 is arranged so as to bridge between the leading end plate 61*b* and the trailing end plate 61*c*. Thereby, the attachment device 62 can fix the optical scanning device 23 positioned between the leading end plate 61*b* and the trailing end plate 61*c*. Incidentally, by reverse procedure to the above-described attaching work, the optical scanning device 23 can be detached.

In accordance with the color printer 1 according to the above-described embodiment, the fixing pin 65 of the attachment device 62 is supported by the leading end plate 61*b* in a state capable of advancing/retreating along the inserting direction of the optical scanning device 23 and incapable of dropping-out. Moreover, the fixing pin is formed connectable to the leading end in the inserting direction of the optical scanning device 23. Therefore, since it is unnecessary to position the screw portion 72 to the screw hole 53, it is possible to easily connect the fixing pin 65 to the optical scanning device 23 inserted into the apparatus body 2 in a narrow space in the apparatus body 2. Further, by fastening the screw portion 72 to the screw hole 53, it is possible to easily and tightly connect the fixing pin 65 to the optical scanning device 23.

Moreover, since the fixing pin 65 is supported incapable of dropping-out by the leading end plate 61*b*, it is possible to prevent loss of the fixing pin 65 removed (connection-released) from the optical scanning device 23. Further, the biasing member 66 of the attachment device 62 makes the biasing force acted on the optical scanning device 23 via the fixing pin 65 and holds the optical scanning device 23 at the position gravitated to the leading end plate 61*b*. That is, by connection of the fixing pin 65 of the attachment device 62, it is possible to position the optical scanning device 23 in the left and right directions.

Furthermore, in accordance with the color printer according to the above-described embodiment, by inserting the first positioning boss 51*b* into the first positioning hole 63*b* elongated vertically, and simultaneously, fitting the second positioning boss 52*b* into the second positioning hole 64*b* of a perfect circle at the center in the forward and backward directions, the optical scanning device 23 becomes a state positioned in the forward and backward directions. Moreover, by respectively inserting the first positioning bosses 51*a* and 51*c* into the pair of front and rear first positioning holes 63*a* and 63*c* elongated horizontally, and simultaneously, fitting the second positioning boss 52*b* into the second positioning hole 64*b* of a perfect circle at the center in the forward and backward directions, the optical scanning device 23 becomes a state supported at three points and positioned in the upward and downward directions. Thereby, it is possible to support the optical scanning device 23 in a stable state.

Incidentally, although, in the embodiment, the optical scanning device 23 as the attached object is provided with the respective positioning bosses 51*a* to 51*c* and 52*a* to 52*c* and the leading end plate 61*b* is provided with the respective positioning holes 63*a* to 63*c* and 64*a* to 64*c*, the present invention is not restricted by this. For example, the optical scanning device 23 may be provided with the positioning hole and the leading end plate 61*b* may be provided with the positioning boss, but illustration is omitted.

Incidentally, although, in the embodiment, the two attachment devices 62 are provided, the present invention is not restricted by this. One or more attachment devices 62 may be provided.

Incidentally, although, in the embodiment, a case of attaching the optical scanning device 23 as the attached object was described, the present invention is not restricted by this. For example, the above-described attaching mechanism 60 may be applied for attaching the drum unit 22 as the attached object composing the image forming part 11.

Incidentally, although, in the present embodiment, a case where the present invention is applied to the color printer 1 has been described as one example, the present invention is not restricted by this, but may be applied to a monochrome printer, a facsimile, a multifunction peripheral or the like.

Incidentally, the above-description of the embodiments illustrates one aspect of the image forming apparatus according to the present invention, but the technical scope of the invention is not limited to the above-described embodiments. Components in the above-described embodiment can be appropriately exchanged and combined with existing components, and then, the above-description of the embodiments does not limit the content of the invention described in the claims.

The invention claimed is:

1. An image forming apparatus comprising:

an optical scanning device;

a frame supporting the optical scanning device inserted from one side to another side into an apparatus body; and an attachment device fixing the optical scanning device supported by the frame, wherein the frame includes a leading end plate arranged to face to a leading end in an inserting direction of the optical scanning device, the attachment device is configured to include:

a fixing pin supported by the leading end plate in a state capable of advancing/retreating along the inserting direction of the optical scanning device and formed connectable to the leading end in the inserting direction of the optical scanning device;

a biasing member biasing the fixing pin toward the inserting direction of the optical scanning device; and a locking member restricting dropout of the fixing pin biased by the biasing member, the attachment device holding the optical scanning device being connected to the fixing pin and receiving an action of the biasing force of the biasing member at a position gravitated to the leading end plate, the optical scanning device includes a first positioned part arranged on the leading end in the inserting direction and a second positioned part arranged on a trailing end in the inserting direction, the frame further includes a trailing end plate arranged to face to the trailing end in the inserting direction of the optical scanning device, the leading end plate includes a first positioning part engaging with the first positioned part of the optical scanning device, the trailing end plate includes a second positioning part engaging with the second positioned part of the optical scanning device, the first positioning part of the leading end plate is three first positioning holes arranged in parallel in horizontal direction, the first positioning hole at the center in the horizontal direction is formed in an elongated shape in a vertical direction and the first positioning holes at both ends in the horizontal direction are formed in an elongated shape in the horizontal direction, the second positioning part of the trailing end plate is three second positioning holes arranged in parallel in horizontal direction, the second positioning hole at the center in the horizontal direction is arranged coaxial to the first positioning hole at the center in the horizontal direction, the second positioning holes at both ends in the horizontal direction are respectively arranged coaxial to the first positioning holes at both ends in the horizontal direction, the second positioning holes at both ends in the horizontal direction are formed to have diameters larger than the second positioning hole at the center in the horizontal direction, the first positioned part of the optical scanning device is three first positioning bosses arranged in parallel in the horizontal direction so as to be inserted into the respective first positioning holes, and the second positioned part of the optical scanning device is three second positioning bosses arranged in parallel in the horizontal direction so as to be inserted into the respective second positioning holes.

2. The image forming apparatus according to claim 1, wherein the optical scanning device includes a screw hole arranged on the leading end in the inserting direction, and the fixing pin includes a screw portion screwed into the screw hole.

3. The image forming apparatus according to claim 1, wherein the first positioning part of the leading end plate is three first positioning holes arranged in parallel in a horizontal direction, the first positioning hole at the center in the horizontal direction is formed in an elongated shape in a vertical direction and the first positioning holes at both ends in the horizontal direction are formed in elongated shapes in the horizontal direction, the second positioning part of the trailing end plate is a second positioning hole arranged at the center in the horizontal direction, the second positioning hole is arranged coaxial to the first positioning hole at the center in the horizontal direction, the first positioned part of the optical scanning device is three first positioning bosses arranged in parallel in the horizontal direction so as to be inserted into the respective first positioning holes, and the second positioned part of the optical scanning device is a second positioning boss provided as to fit into the second positioning hole.

* * * * *